US009004305B2

(12) United States Patent
Barron

(10) Patent No.: US 9,004,305 B2
(45) Date of Patent: Apr. 14, 2015

(54) CUTTING DEVICE FOR CONTAINER COVERINGS

(75) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/236,889

(22) PCT Filed: Jun. 4, 2012

(86) PCT No.: PCT/EP2012/060503
§ 371 (c)(1),
(2), (4) Date: Feb. 3, 2014

(87) PCT Pub. No.: WO2013/017316
PCT Pub. Date: Feb. 7, 2013

(65) Prior Publication Data

US 2014/0151374 A1 Jun. 5, 2014

(30) Foreign Application Priority Data

Aug. 1, 2011 (DE) ..... 10 2011 080 209

(51) Int. Cl.
*B65D 17/44* (2006.01)
*B65D 17/00* (2006.01)
*B65D 5/74* (2006.01)

(52) U.S. Cl.
CPC ..... *B65D 17/16* (2013.01); *B65D 5/747* (2013.01)

(58) Field of Classification Search
CPC ..... B65D 17/16; B65D 5/747
USPC ..... 220/258.4, 267, 277, 260, 265; 215/257, 297, 296, 295; 222/80, 81, 222/91, 541.2
See application file for complete search history.

(56) References Cited

U.S. PATENT DOCUMENTS 5,297,696 A 3/1994 Bernstein et al.
6,233,924 B1 5/2001 Kerns
(Continued)

FOREIGN PATENT DOCUMENTS

EP 0328652 8/1989
EP 1396435 3/2004
(Continued)

OTHER PUBLICATIONS

International Search Report for Application No. PCT/EP2012/060503 dated Aug. 14, 2012 (4 pages).

*Primary Examiner* — Robert J Hicks
*Assistant Examiner* — Kareen Rush
(74) *Attorney, Agent, or Firm* — Michael Best & Friedrich LLP

(57) ABSTRACT

The present invention discloses a container cover produced from a plastics film, having a rotating closure which has a rotatable cylindrical cutting device (100, 300), wherein the latter has a lower rim (110) on which at least one cutting edge section (120) is arranged, and wherein said at least one cutting edge section (120) has at least three teeth (130) which are located on a line extending in an inclined manner in relation to the bag, and wherein the front-most tooth in the direction of rotation comes first into contact with the plastics film during the cutting operation. The cutting device (100, 300) is characterized in that the inclination of the line on which the teeth (130) of each cutting edge section are located is selected such that, in the case of at least approximately maximum deformation of the plastics film before the latter is perforated by the front-most tooth, at least two following teeth of the same cutting edge section (120) are in direct contact with the plastics film.

21 Claims, 5 Drawing Sheets

(56) References Cited

U.S. PATENT DOCUMENTS

| | | | | |
|---|---|---|---|---|
| 7,484,641 | B2 * | 2/2009 | Casale et al. | 222/83.5 |
| 2010/0264146 | A1 * | 10/2010 | Casale et al. | 220/278 |

FOREIGN PATENT DOCUMENTS

| | | |
|---|---|---|
| EP | 1396436 | 3/2004 |
| EP | 1795456 | 6/2007 |
| EP | 2287082 | 2/2011 |
| FR | 2779418 | 12/1999 |
| FR | 27779418 | 12/1999 |
| JP | 11171233 | 6/1999 |
| WO | 2004083055 | 9/2004 |

* cited by examiner

CUTTING DEVICE FOR CONTAINER COVERINGS

BACKGROUND OF THE INVENTION

The present invention relates to a cutting device for cutting through a container covering which consists of plastic, paper, cardboard, light metal or laminated layers made from at least two of the aforementioned materials.

Known cutting devices for cutting through a container covering as disclosed, for example, in EP 1 396 436 comprise a cutting element which is mounted screw-like in the closure cap and is movable in the direction of the container covering, the cutting edge of said cutting element having at least a number of teeth extending along the cutting edge in the direction which is opposed to the direction of rotation. The teeth are arranged such that they gradually increase in height along the direction of rotation, such that the distance between the teeth and the container covering decreases in the direction of rotation. As a result, the frontmost tooth in the direction of rotation has the highest tooth tip and thus is the first to pierce the container covering. The subsequent teeth, which are located behind the frontmost tooth in the direction of rotation and gradually increase in their distance to the container covering, thus contribute only marginally or not at all toward the cutting operation on the container covering. In other words, in the course of its rotation, the illustrated and described cutting device acts on the container covering in a cutting manner in a kind of stabbing motion by means of the frontmost tooth in the direction of rotation.

Accordingly, in the course of the cutting operation through the container covering, the high forces act mainly on the frontmost blade, causing a blunting of said blade in the course of the cutting operation and thus a reduction of the cutting efficiency.

Moreover, these comparatively high forces mainly occurring on the frontmost blade of the cutting device may lead to an unintended flexing or bending of the frontmost tooth of the cutting device in relation to the container covering and thus to a reduction of the cutting efficiency, this in turn resulting in an increase in torque that has to be applied.

A further known phenomenon which occurs in the course of a cutting device impinging on a container covering is the formation of endemic elongations in the rotational path of the cutting device in the course of cutting the container covering. The formation of such endemic elongations has a complicating effect on the cutting operation, in as far as said elongations lead to an orientation of molecules in the direction of tensile force and increase the Young's modulus, and thus lead to higher forces on the teeth, as a result of which the latter may deviate from the rotational path or even break off. Furthermore, fibers may accumulate on the cutting edge, such that one or a plurality of the laminated films or membranes which are to be cut through/torn through are protected from the cutting edge by the fibers and are only stretched or incompletely cut through in the course of the rotation. This causes a frayed cut line, as a result of which the pouring stream is impeded or deflected when exiting, and the contents are accordingly partially spilt. Moreover, these fibers may detach themselves from the container covering and fall into the interior of the container covering in an uncontrolled manner.

The disadvantages of the known cutting devices which have been mentioned up to this point have been known to the person skilled in the art for years. Known cutting devices are suited to cut through films and membranes which typically have a material density of only 0.910-0.940 g/cm3 and a thickness of 30 to 150 μm. These parameters are typical of materials consisting of low-density polyethylene. As a result, the container covering has to consist of a material which is cuttable by the cutting device at least in the location which is to be cut open. However, in most cases the aforementioned density and/or thickness of such cuttable materials is not sufficient to allow the contents in the container coverings made of pure plastic film to be stored reliably in a lasting manner. In other words, material which can be cut using known cutting devices may tear relatively easily and/or actually burst under pressure prevailing in the course of usage. It is, therefore, necessary to produce a container covering consisting of pure plastic film from high-density polyethylene. This material, however, could not be cut open with the known cutting devices. Accordingly, cutting devices have to date only been applied to container coverings made of laminated film material, or to container coverings which consist of high-density polyethylene and have a cutout which has been welded closed using a patch of low-density polyethylene, the closure device with the cutting device being then welded onto said patch such that the cut could be applied to the film material made of low-density polyethylene.

Accordingly, the outlay involved in the production of a container covering of this type and in the attachment of the cutting device thereto is high.

Further known closure devices have so-called cutting devices or piercing elements which at least in their mode of operation are similar to the closure device disclosed in EP 1 396 436. WO2004/083055, for example, discloses a cutting device which is mounted slidably in a screw-like manner in the closure cap and has means such that the piercing element is moved in the direction of the container covering in the course of the initial unscrewing motion of the screw cap. This cutting element has a cutting edge which, like in EP 1 396 436, has a main blade penetrating the container covering in a stabbing cutting manner by means of the screw-like motion of the cutting edge. In the prior art known hitherto, in each case only the frontmost cutting edge of each cutting element acts in a stabbing cutting manner on the container covering. Accordingly, the piercing element which is disclosed in WO2004/083055 also has the same problems at least in terms of the occurring forces and effects as the cutting device which is disclosed in EP 1 396 436.

SUMMARY OF THE INVENTION

It is thus an object of the present invention to provide a cutting device of the type mentioned in the introduction which requires a lower torque in its application and due to the design of which the attachment of the cutting device to a patch of cuttable material is dispensed with, which in turn reduces the production outlay for the container covering and the attachment of the cutting device thereto.

The present invention relates to a rotatable cylindrically shaped cutting device for a rotatable closure for the severance of a container covering which is made from a plastic film and to which said cutting device is to be attached. The cutting device has a cutting element, on the lower rim of which at least one cutting edge section is located. This cutting edge section has at least three, four, five, six, seven, eight, nine, ten, eleven or twelve teeth which lie on a line which extends at an incline in relation to the bag covering, such that the frontmost tooth in the direction of rotation first comes into contact with the plastic film in the course of the cutting operation.

Expressed in other words, in one embodiment of the subject matter of the invention, in the assembled state the distance between the tips of the at least three teeth and the container covering, which is to be cut through, belonging to the closure device on the container covering varies, such that the tip of the first tooth has the smallest distance to the container covering, and the distance to the container covering increases successively for each subsequent tooth.

Furthermore, in one embodiment of the subject matter of the invention, the inclination of the line on which the teeth lie is chosen such that upon occurrence of at least approximately maximum deformation of the container covering, prior to the perforation thereof by the first tooth, at least two subsequent teeth of the same cutting edge section are also in direct contact with the container covering.

In one embodiment of the invention, the cutting element has a plurality of cutting edge sections, each cutting edge section being provided with a separate set of a plurality of teeth and being located at a distance from a recess.

In one embodiment of the invention, the recess is configured like a hook with a tapered recess strip with a tear-off edge.

In one embodiment of the invention, the cutting device has along its circumference a cutout which, for example, measures at most up to half of the entire circumferential line of the cutting device.

In one embodiment of the invention, the container covering which can be cut open by the cutting device consists of materials from one of the following group: plastic, paper, light metal, cardboard and multilayer laminated films made from at least two of the aforementioned materials.

In one embodiment of the invention, the plastic film consists of one of the following materials: polypropylene, polyethylene and polyamide.

In one embodiment, the light metal consists of aluminum (for example with a thickness of at least approximately 8 μm).

In one embodiment of the invention, the closure device comprises a rotatable cutting device according to one of the embodiments mentioned in the introduction.

BRIEF DESCRIPTION OF THE DRAWINGS

Preferred embodiments of the subject matter of the invention are illustrated in detail in the figures.

Figure 1B:
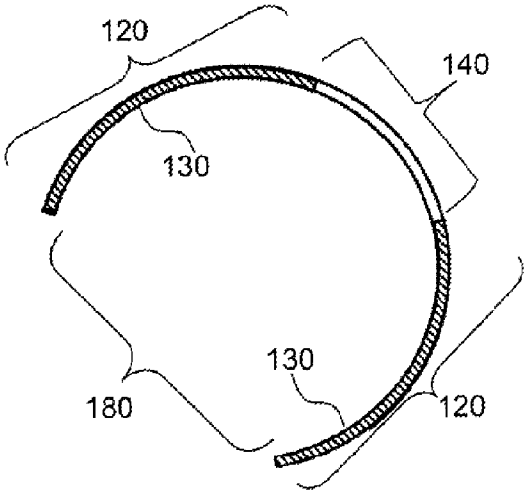
FIG. 1B shows schematically a plan view of a lower rim of a cutting element of a cutting device according to the first embodiment of the subject matter of the invention.
Figure 1A:
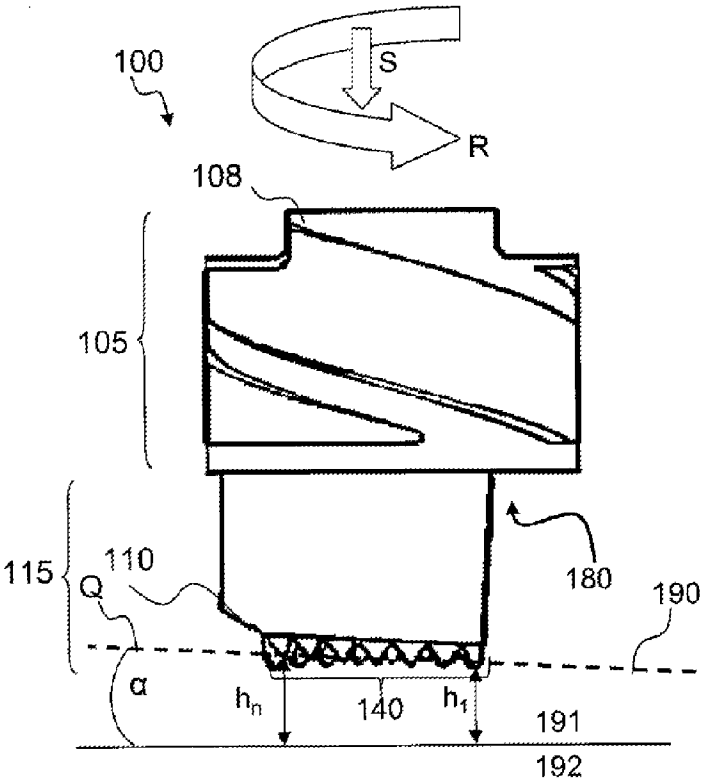
FIG. 1A shows schematically a lateral view of a cutting device having two cutting edge sections and one set of teeth each having an inclination α in relation to the container covering which is mounted thereon, according to a first embodiment of the subject matter of the invention.
Figure 2B:
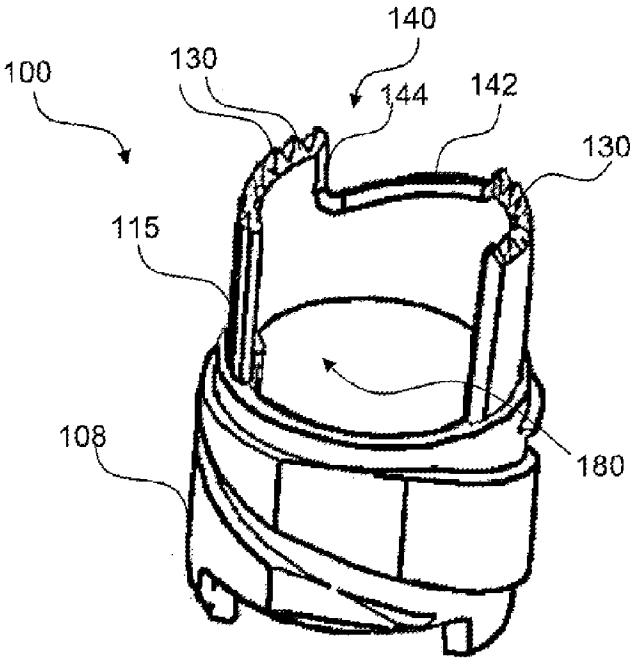
FIG. 2B shows schematically a view from below of the cutting device which, with reference to the view as in FIG. 1A, is turned by 90°, according to the first embodiment of the subject matter of the invention.
Figure 2A:
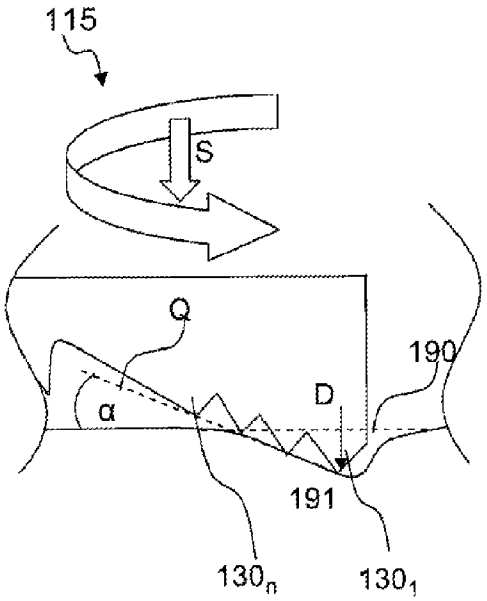
FIG. 2A shows schematically a partial lateral view of a cutting element of a cutting device which is in contact with a container covering, according to the first embodiment of the subject matter of the invention.

It should be noted here that, for the sake of clarity and simplicity, elements in the figures are not necessarily illustrated accurately to scale. The dimension of certain elements in relation to other elements may, for example, be illustrated in an exaggerated manner. Furthermore, reference signs are not always repeated for identical elements in different figures.

DETAILED DESCRIPTION

With reference to FIG. 1A, FIG. 1B, FIG. 2A and FIG. 2B, a cylindrical and rotatable cutting device 100 for cutting through a container covering 190 comprises a cutting element 115 and a screw element 105 having a thread 108, said screw element having a screw connection to a closure cap (not illustrated). The screw element 105 and the cutting element 115 are mechanically coupled to one another, and are, for example, monolithically formed together or welded together. In appropriate embodiments of the invention, the outermost diameter of the screw element 105, or the diameter of the external thread, respectively, is greater than, the same as or smaller than the outermost diameter of the cutting element 115.

On the lower rim 110 of the cutting element 115, at least one cutting edge section 120 is arranged cylindrically and in the direction of rotation of the cutting device 100.

The cutting edge section 120 comprises, for example, at least 3, 4, 5, 6, 7, 8, 9, 10, 11 or 12 teeth 130, the inclination α of the virtual line Q on which the teeth 130 lie being chosen such that the frontmost tooth 130 in the direction of rotation R is the first to come into contact with the container covering 190 in the course of the cutting operation.

The tips of the teeth 130 are accordingly arranged on the lower rim 110 of the cutting element 115 in such a manner that, when the cutting device 100 is mounted on the container covering 190, the distance h between the tips of the teeth 130 and the container covering 190 which lies beneath varies such that the tip of the frontmost tooth 130 in the direction of rotation R has the smallest distance h1 to the container covering 190, and the tip of the last tooth 130*n* has the greatest distance hn, wherein the distances to the container covering 190 successively increase from the first tooth 1301 to the last tooth 130*n*, in the assembled state.

Furthermore, the cutting element 115 and the closure cap are arranged such that the initial unscrewing of the closure cap rotates the cutting element 115 in the direction of rotation R, and also moves said cutting element linearly in direction S toward the container covering 190. In other words, the cutting element 115 moves screw-like toward the container covering 190.

As a result of the teeth 1301-*n* being arranged in the assembled state such that the distances or heights h1-*n* in relation to the container covering 190 correspondingly successively decrease in the direction of rotation R, the frontmost tooth 130 is the first to be in contact with the container covering 190. By means of the force which is exerted by the frontmost tooth 130 on the container covering 190, the latter is stretched in the direction of the contents of the container and deformed (arrow D). As illustrated schematically in FIG. 2A, in one embodiment of the subject matter of the invention the inclination α of the line Q is chosen such that upon occurrence of at least approximately maximum deformation of the container covering 190, prior to its perforation by the frontmost tooth 130, at least two subsequent teeth 1302 and 1303 are also in direct contact with the container covering 190. Consequently, at least three teeth 130 act in a cutting manner on the container covering 190 at least almost simultaneously in the course of a further downward movement S of the cutting element 115 toward the container covering 190. As a result, the load which is required to cut open the container covering 190 is distributed across these at least three teeth 130, with the consequence that the buckling and impact load acting on each individual tooth 130 is decreased accordingly (in comparison to the buckling load to which an individual tooth is exposed when in each case only one tooth acts on the container covering 190 in a cutting manner), such that the cutting element 115 acts on the container covering 190 in a cutting manner at a plurality of points, requiring a comparatively low effort of force.

The cutting device 300 which is schematically illustrated in FIG. 1A, FIG. 1B, FIG. 2A and FIG. 2B has two cutting edge sections 120. Two cutting edge sections 120 may be suitable for a cutting device 100 having a nominal diameter of, for example, 10 mm or less.

Figure 3B:
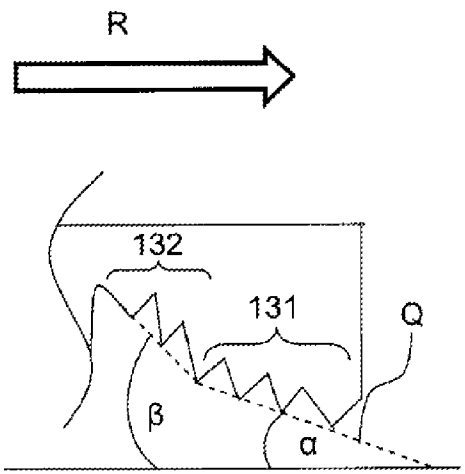
FIG. 3B shows schematically a lateral view of a cutting element in elongated form, according to the second embodiment of the subject matter of the invention.
Figure 3A:
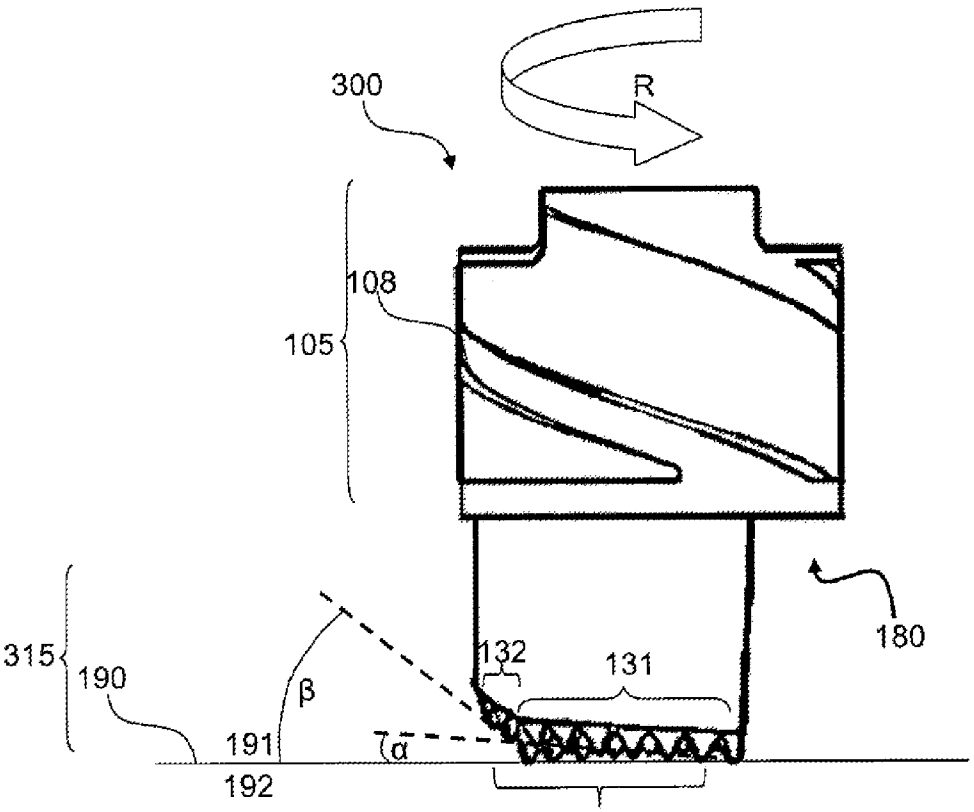
FIG. 3A shows schematically a lateral view of a cutting device with two cutting edge sections each having at least two sets of teeth which, in their assembled state, each have corresponding inclinations α and β, according to a second embodiment of the subject matter of the invention.

In one embodiment of the invention, the virtual line Q on which the teeth 130 lie has at least two inclinations in relation to the container covering 190 which lies underneath. With reference to FIG. 3A and FIG. 3B, the virtual line Q has two inclinations $\alpha$ and $\beta$, where $\alpha<\beta$, such that the inclination of a first set 131 of teeth 130 is less steep than the inclination of a second set 132 of teeth 130 located downstream of the first set 131 in the direction of rotation R. The teeth 130 of the second set 132 serve to completely cut through any potentially incompletely cut-through fibers of the container covering 190.

The points of the container covering 190 which are at best only incompletely cut through by the first set 131 are finally completely cut through by the second set 132. Since the second set 132 cuts through points which have already been initially cut by the first set 131, the required torque is not increased despite the steeper angle $\beta$ of the second set 132 in comparison to the flatter angle $\alpha$ of the first set 131.

Figure 4:
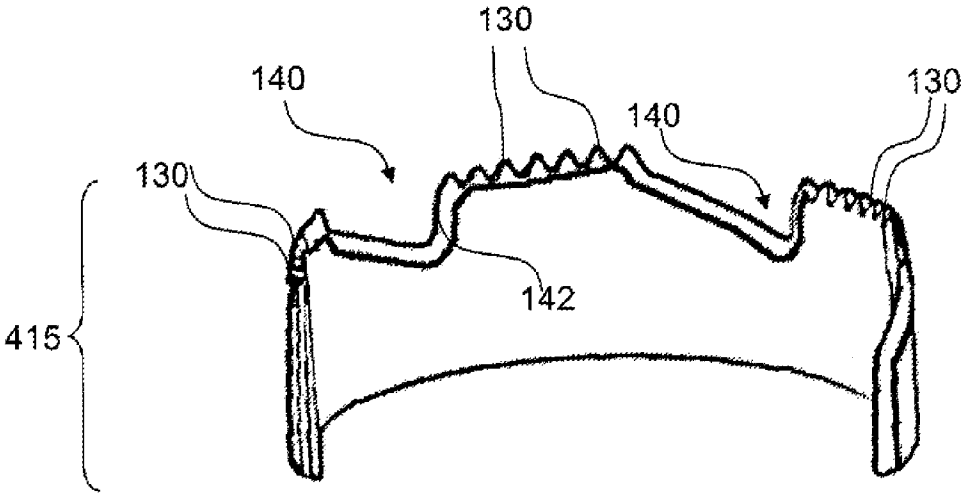
FIG. 4 shows schematically a perspective view of a cutting element with three cutting edge sections, according to a third embodiment of the subject matter of the invention.

With reference to FIG. 4, a cutting element 415 may have three cutting edge sections 120. A number of three cutting edge sections 120 may be suitable for a cutting device 100 having a nominal diameter of, for example, more than 20 mm. It should be noted in this instance that, in one embodiment of the invention, the cutting element 115 has only one cutting edge section 120, for example when the cutting element 115 has a nominal diameter of less than, for example, 10 mm, without sustaining a loss in the evenness of the forces acting on the cutting device 100.

In one embodiment of the invention, the pitch and the angle of inclination of the screw element 105 having the cutting element 115 are designed such that the complete unscrewing of the closure cap from the screw element 105 causes the cutting element 115 to act on the container covering 190 in such a manner that the container covering 190 lying beneath the cutting element 115 (further referred to as "opening piece") is only incompletely cut into and thus not completely cut off, thus preventing the cut-out opening piece from falling off into the contents of the container covering. For example, the cutting element 115 is designed such that, in the course of the initial unscrewing of the closure cap, the cutting element 115 follows a circular carving path, the circumferential length of this carving path being, for example, at least 50% to 70% and at most 70% to 99% of the at least approximately circular circumference of the cutting element 115.

In order to achieve the desired circumferential length, the number and/or the arc length of the cutting edge sections 120 in corresponding embodiments of the invention in each case vary with the diameter of the cutting device 100, i.e. as explained with reference to the following examples, a larger/smaller nominal diameter (and radius) of the cutting device 100 in each case requires the arrangement of a correspondingly larger/smaller number of cutting edge sections 120 and/or a longer/shorter arc length of the cutting edge sections 120, wherein two successive cutting edge sections 120 are located beside one another spaced apart by a recess 140. Consequently, the cutting device 100, having a plurality of cutting edge sections 120, has at least one recess 140.

In an arrangement having a plurality of cutting edge sections 120, a multiplicity of cutting edge sections 120 are in simultaneous contact with the container covering 190 in the course of the cutting operation, such that an opening piece of the container covering 190 is cut into/sheared off at a plurality of points simultaneously.

The extensive number of cutting edge sections 120 in proportion to the diameter of the cutting device 100 leads to the force loads being as evenly distributed as possible across the cutting element 115 in the course of the screw-like cutting motion.

In one embodiment of the invention, the cutting device 100 has a cutout 180 located on its circumference. This cutout 180, in one embodiment, measures, for example, at most half of the total circumference of the cutting device 100. The cutting device 100 which is designed with the cutout 180 enables an unimpeded flow of the contents of the container/product from the opening of the spout (not illustrated) through the cutout 180.

Figure 5:
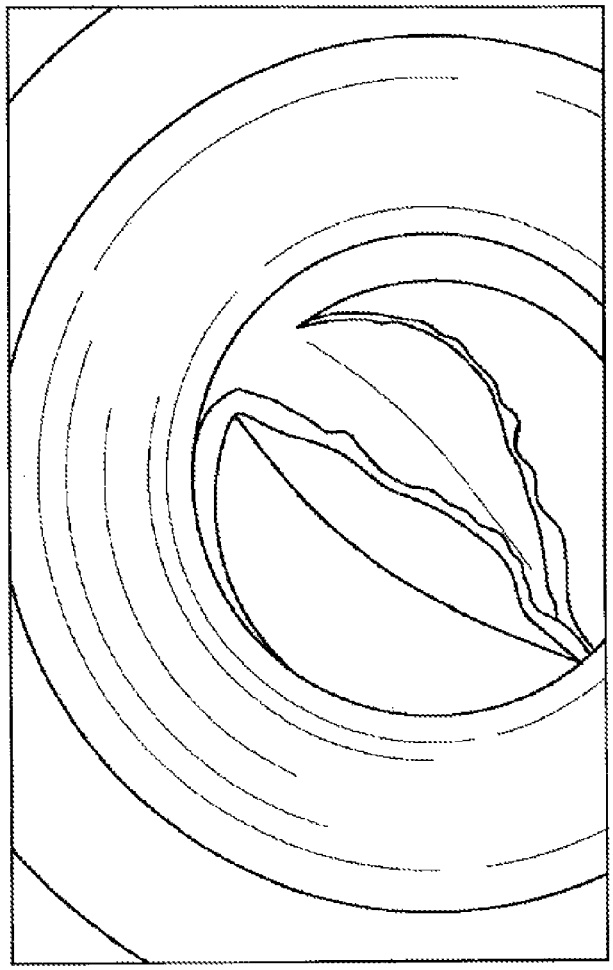
FIG. 5 is an outline diagram which shows schematically the folding over of the opening piece toward the inside of the container covering.

Irrespective of the number of cutting edge sections 120, the opening piece is folded over toward the inside 192 of the container covering 190 by the forces of the cutting device 100 which act from the outside 191 toward the inside 192 on the container covering 190 in the course of the cutting operation. FIG. 5 shows an outline diagram illustrating schematically the folding over of the opening piece toward the inside 192 of the container covering 190.

As mentioned in the introduction, fibers may accumulate on the cutting edge section 120, such that one or a plurality of the laminated films or membranes of the container covering 190 which are to be cut through are protected from the cutting edge section 120 by these fibers and are only stretched or incompletely cut through in the course of the rotation. In order to completely cut into such potentially incompletely cut-into films or membranes, the recess 140 is configured like a hook with a tapered recess strip 142 with a tear-off edge 144. Thus, such fibers hook into the tear-off edge 144 as a result of the screw-like rotational motion of the cutting element 115, whereupon the continuing rotational motion shears off these fibers and completely separates the corresponding container material from the container covering 190.

The torque M which has to be applied to this cutting device 100 to cut into the container covering 190 is, for example, approximately 60-70% of the torque required in known cutting devices according to the prior art.

In one embodiment of the invention, the cutting device 100 is suited to cutting open a container covering 190 which comprises materials from one of the following group: plastic, paper, light metal, cardboard and multilayer laminated films made from at least two of the aforementioned materials.

In one embodiment of the invention, the plastic film consists of at least one of the following materials: polypropylene, polyethylene and polyamide.

In one embodiment of the invention, the light metal consists of aluminum having, for example, a thickness of 8 μm. Furthermore, a closure device which is mountable on the container covering 190 comprises a rotatable cutting device 100 according to one embodiment of the invention.

The invention claimed is:

1. A rotatable cylindrical cutting device (100, 300) for cutting through a container covering made from plastic film having a rotating closure, wherein said cutting device has a lower rim (110) on which at least one cutting edge section (120) is located, wherein the at least one cutting edge section (120) has at least three teeth (130) which lie on a line which extends at an incline in relation to the covering, and wherein a frontmost tooth in a direction of rotation first comes into contact with the plastic film in the course of a cutting operation, characterized in that an inclination of the line on which the teeth (130) of the at least one cutting edge section lie is such that upon occurrence of at least approximately maximum deformation of the plastic film, prior to perforation thereof by the frontmost tooth, at least two subsequent teeth of the same cutting edge section (120) are in direct contact with the plastic film.

2. The rotatable cutting device (100) as claimed in claim 1, wherein the lower rim (110) has a plurality of cutting edge sections (120), wherein each cutting edge section (120) is provided with a multiplicity of teeth (130) and is located at a distance from a recess (140).

3. The rotatable cutting device (100) as claimed in claim 2, wherein an inclination of the line on which the teeth (130) of each cutting edge section lie is such that upon occurrence of at least approximately maximum deformation of the plastic film, prior to perforation thereof by the frontmost tooth, at least half the number of subsequent teeth of the same cutting edge section (120) are in direct contact with the plastic film.

4. The rotatable cutting device (100) as claimed in claim 1, wherein upon occurrence of at least approximately maximum deformation of the plastic film, prior to perforation thereof by the frontmost tooth, the majority of the number of subsequent teeth of the same cutting edge section (120) are in direct contact with the plastic film.

5. The rotatable cutting device (100) as claimed in claim 1, wherein the recess (140) is configured with a recess strip (142) tapered like a hook with a tear-off edge (144).

6. The rotatable cutting device (100, 300) as claimed in claim 1, wherein the cutting device (100) has along a circumference a cutout (180) which measures at most half of an entire circumferential line of the cutting device (100).

7. The rotatable cutting device (100) as claimed in claim 1, wherein the container covering (190) is composed from materials from one of the following group: plastic, paper, light metal, cardboard and multilayer laminated films made from at least two of the aforementioned materials.

8. The rotatable cutting device (100, 300) as claimed in claim 7, wherein the container covering consists of one of the following materials: polypropylene, polyethylene and polyamide.

9. The rotatable cutting device (100, 300) as claimed in claim 7, wherein the light metal consists of aluminum.

10. The rotatable cutting device (300) as claimed in claim 1, wherein the teeth (130) in an assembled state form two angles with the container covering (190), wherein a first set of teeth (131) forms a flatter angle ($\alpha$) with the container covering than an angle ($\beta$) of a second set of teeth (132) which is located downstream in the direction of rotation (R).

11. A closure device which is mountable on a container covering (190) and comprises a rotatable cutting device (100) as claimed in claim 1.

12. A container comprising a container covering made from plastic film having a rotating closure, and rotatable cylindrical cutting device (100, 300), wherein said cutting device has a lower rim (110) on which at least one cutting edge section (120) is located, wherein the at least one cutting edge section (120) has at least three teeth (130) which lie on a line which extends at an incline in relation to the covering, wherein a frontmost tooth in a direction of rotation first comes into contact with the plastic film in the course of a cutting operation, an and wherein an inclination of the line on which the teeth (130) of the at least one cutting edge section lie is such that upon occurrence of at least approximately maximum deformation of the plastic film, prior to perforation thereof by the frontmost tooth, at least two subsequent teeth of the same cutting edge section (120) are in direct contact with the plastic film.

13. The container as claimed in claim 12, wherein the lower rim (110) has a plurality of cutting edge sections (120), wherein each cutting edge section (120) is provided with a multiplicity of teeth (130) and is located at a distance from a recess (140).

14. The container as claimed in claim 13, wherein an inclination of the line on which the teeth (130) of each cutting edge section lie is such that upon occurrence of at least approximately maximum deformation of the plastic film, prior to perforation thereof by the frontmost tooth, at least half the number of subsequent teeth of the same cutting edge section (120) are in direct contact with the plastic film.

15. The container as claimed in claim 12, wherein upon occurrence of at least approximately maximum deformation of the plastic film, prior to perforation thereof by the frontmost tooth, the majority of the number of subsequent teeth of the same cutting edge section (120) are in direct contact with the plastic film.

16. The container as claimed in claim 12, wherein the recess (140) is configured with a recess strip (142) tapered like a hook with a tear-off edge (144).

17. The container as claimed in claim 12, wherein the cutting device (100) has along a circumference a cutout (180) which measures at most half of an entire circumferential line of the cutting device (100).

18. The container as claimed in claim 12, wherein the container covering (190) is composed from materials from one of the following group: plastic, paper, light metal, cardboard and multilayer laminated films made from at least two of the aforementioned materials.

19. The container as claimed in claim 18, wherein the container covering consists of one of the following materials: polypropylene, polyethylene and polyamide.

20. The container as claimed in claim 18, wherein the light metal consists of aluminum.

21. The container as claimed in claim 12, wherein the teeth (130) in an assembled state form two angles with the container covering (190), wherein a first set of teeth (131) forms a flatter angle ($\alpha$) with the container covering than an angle ($\beta$) of a second set of teeth (132) which is located downstream in the direction of rotation (R).

* * * * *